US010654184B1

(12) United States Patent
Richitelli

(10) Patent No.: US 10,654,184 B1
(45) Date of Patent: May 19, 2020

(54) RAZOR FOR SHAVING

(71) Applicant: Angel Lia Richitelli, Pembroke Pines, FL (US)

(72) Inventor: Angel Lia Richitelli, Pembroke Pines, FL (US)

( * ) Notice: Subject to any disclaimer, the term of this patent is extended or adjusted under 35 U.S.C. 154(b) by 0 days.

(21) Appl. No.: 16/593,819

(22) Filed: Oct. 4, 2019

(51) Int. Cl.
*B26B 21/40* (2006.01)
*B26B 21/14* (2006.01)

(52) U.S. Cl.
CPC ..... *B26B 21/4031* (2013.01); *B26B 21/14* (2013.01); *B26B 21/4012* (2013.01); *B26B 21/4062* (2013.01)

(58) Field of Classification Search
CPC ..... B26B 21/00; B26B 21/08; B26B 21/14; B26B 21/16; B26B 21/22; B26B 21/222–227; B26B 21/40; B26B 21/4012; B26B 21/4031; B26B 21/4037; B26B 21/4062
USPC ..... 30/34.1, 47–51
See application file for complete search history.

(56) References Cited

U.S. PATENT DOCUMENTS 2,294,284 A * 1/1942 Chu ..... B26B 21/24 30/47
2,505,493 A * 4/1950 Herrmann ..... B26B 21/22 30/50
3,872,592 A * 3/1975 Iten ..... B26B 21/24 30/50
3,972,114 A * 8/1976 Chao ..... B26B 21/40 30/50
4,501,066 A * 2/1985 Sceberras ..... B26B 21/22 30/47
5,426,853 A * 6/1995 McNinch ..... B26B 21/14 30/48
5,848,475 A * 12/1998 Hill ..... B26B 21/16 30/51
6,247,234 B1 * 6/2001 Hill ..... B26B 21/22 30/34.1
6,418,623 B1 * 7/2002 Marcarelli ..... B26B 21/22 30/34.1
7,721,451 B2 * 5/2010 Psimadas ..... B26B 21/22 30/34.1
8,533,959 B2 * 9/2013 Davis ..... B26B 21/227 30/34.1
8,671,576 B1 * 3/2014 Hotella ..... B26B 21/4012 30/34.1
2016/0263757 A1 * 9/2016 Vandervelde ..... B26B 21/4062
(Continued)

FOREIGN PATENT DOCUMENTS

FR 2524366 A1 * 10/1983 ..... B26B 21/24

*Primary Examiner* — Jason Daniel Prone

(57) ABSTRACT

A razor having a handle, a head and a main blade housing assembly. The main blade housing assembly defines a first end, a second end and has at least one main blade mounted thereon. At least one first extension blade is mounted on a first extension blade housing assembly. At least one second extension blade is mounted on a second extension blade housing assembly. In a stored configuration at least substantially all of the first extension blade and second extension blade are both positioned between the main blade housing assembly's first end and second end. In an extended configuration at least substantially all of the first extension blade and the second extension blade extends beyond a first end and second end of the main blade.

20 Claims, 22 Drawing Sheets

(56) References Cited

U.S. PATENT DOCUMENTS

2019/0176354 A1* 6/2019 Glaser ..... B26B 21/4062
2019/0315009 A1* 10/2019 Park ..... B26B 21/222

* cited by examiner

RAZOR FOR SHAVING

CROSS-REFERENCE TO RELATED APPLICATIONS

Not applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates razors, and more specifically razors for shaving.

BACKGROUND

A razor is a bladed tool used for the removal of unwanted body hair through the act of shaving. Many different types of razors exist. Razor have been in existence since before the Bronze Age. Currently, the types of razors include straight razors, disposable razor, and electric razors. The most common types of razors in current usage are the safety razor and the electric razor, though other kinds are still in use.

The razor industry is a very large industry. The worldwide market for Razor Blade is expected to reach 2.5 billion USD in 2024 according to a new GIR (Global Info Research) study. This industry and companies are continuously focusing on technological innovation, equipment upgrades, and process improvements, to reduce costs and improve quality.

One problem associated with shaving with modern razors is that many times the blades have a relatively small length. Because of the small length of the razor blades, the amount of time it takes to shave large surface areas may be cost and time prohibitive. For example, veterinarians may use razors for shaving the hair from animals before performing certain procedures.

For larger animals, such as giraffes, lions or bears, the hair removal process completed before a procedure may be a very time-consuming process. Significant increased amounts of time may increase the risk of harm to animals because emergency procedures may not be able to be performed sooner rather than later.

Another challenge with the short length of razors may be the amount of time required for a person to shave his or her body parts. In many countries and societies, women shave their legs for beauty and aesthetic purposes. Additionally, athletes may shave their bodies and legs to decrease drag. The amount of time it takes men and women to shave their legs may be time prohibitive. As a result, there exists a need for improvements over the prior art and more particularly for a more efficient way for women to shave their legs.

SUMMARY

A razor for shaving is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a razor is disclosed. The razor for shaving includes a handle, a head and a main blade housing assembly attached to the head. The main blade housing assembly has a first end and a second end and is configured to have mounted thereon at least one main blade. A first extension blade housing assembly is configured to have mounted thereon at least one first extension blade. A second extension blade housing assembly is configured to have mounted thereon at least one second extension blade. In one embodiment, the razor includes a stored configuration wherein at least substantially all of the at least one first extension blade and the at least one second extension blade are both positioned between the main blade housing assembly's first end and second end. In an extended configuration at least substantially all of the at least one first extension blade and the at least one second blade extension extends beyond a first end and second end of the main blade. In an extended flush configuration, the at least one blade of the first extension blade housing assembly, main housing assembly and second extension blade housing assembly are substantially flush. A first extension blade housing assembly biasing element maintains the first extension blade housing assembly in the extended configuration and a second extension blade housing assembly basing element maintains the second extension blade housing assembly in the extended configuration.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
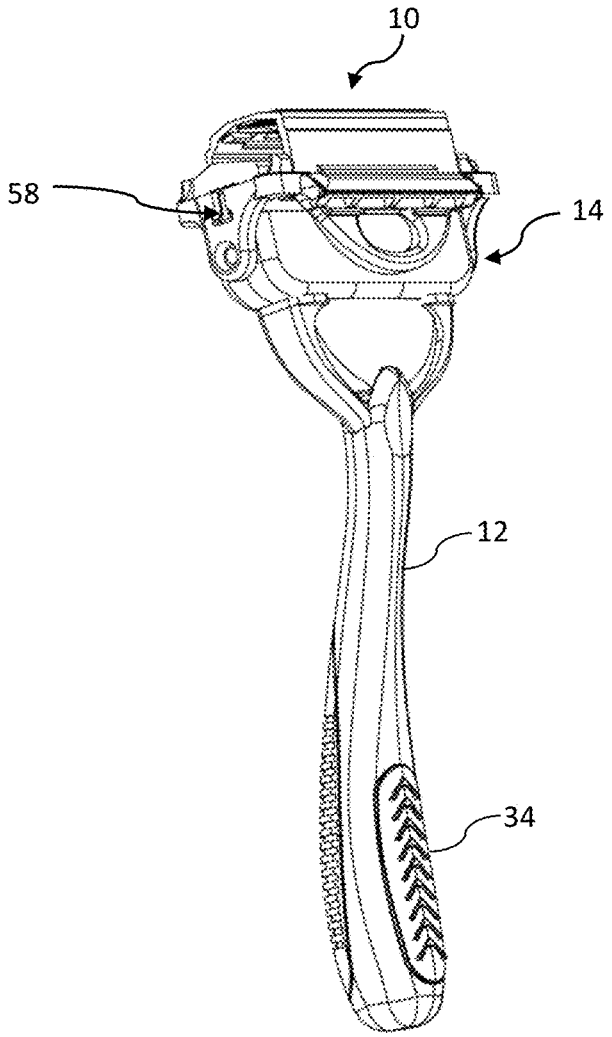
FIG. 1 is a back perspective view of a razor, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a razor with at least one main blade and at least one extension blade. The adjustable length of the razor is provided when the extension blade moves into extended configuration. In a stored configuration, at least substantially all of the at least one first extension blade is both positioned between the main blade housing assembly's first end and second end. In an extended configuration at least substantially all of the at least one extension blade extends beyond a first end and second end of the main blade. In the extended configuration, the amount of hair that may be quickly and easily removed by one pass of the razor is greatly increased. The present invention also may be used in stored configuration. An extension blade biasing element maintains the first extension blade housing assembly in the extended configuration. A lock maintains the first extension blade housing assembly and second extension blade housing assembly in the stored configuration until an unlocking force moves a catch of the lock away from a stop.

Referring now to FIG. 1, a back perspective view is shown of a shaving razor system 10. The shaving razor system 10 may include a handle 12, a head 14, and a main blade housing assembly 16 including a first end 18 and a second end 20, and configured to have mounted thereon at least a main blade 24. The present embodiment includes more than one main blade. In one embodiment, the head 14 may be configured to function as the main blade housing assembly 16 in order to support integration and separation of the head 14 and the handle 12. The main blade housing assembly 16 may include a first extension blade housing assembly 26 configured to have mounted thereon a first extension blade 29 and a second extension blade housing assembly 30 configured to retain a second extension blade 32. The main blade housing assembly 16 may be configured to be disposable or interchangeably mounted onto the head 14, and the main blade housing assembly 16 may be provided in a variety of different widths. In one embodiment, the shaving razor system 10 may include more than one main blade 24, first extension blade 29, and/or second extension blade 32. In one embodiment, the first extension blade housing and second extension blade housings are configured to house only blade. However, it is understood that other amounts of blades may be used and are within the spirit an scope of the present invention.

Each of the housings may be comprised of material such as carbon steel, stainless steel, aluminum. Titanium, other metals or alloys, composites, ceramics, polymeric materials such as polycarbonates, such as Acrylonitrile butadiene styrene (ABS plastic), Lexan™, and Makrolon™ The housing may be formed from a single piece or from several individual pieces joined or coupled together. The components of the housing may be manufactured from a variety of different processes including an extrusion process, a mold, welding, shearing, punching welding, folding etc.

In an embodiment, the handle 12 may include one or more ridged panels 34 configured to support secure grasping and control of the shaving razor system 10 when in use, and one or more reservoirs configured to retain liquids or fluids, such as shaving gel, for the purpose of being dispensed or distributed on the head 14, the main blade housing assembly 16, or any other applicable component of the shaving razor system 10. In one embodiment, the handle 12 may include an internal cavity configured to retain a power source and any other applicable means, such as but not limited to a battery and wiring, in order to support electric powering of the shaving razor system 10. The power source may be a battery power source. In the present embodiment, the battery power source may be a battery power source, such as a standard dry cell battery commonly used in low-drain portable electronic devices (i.e., AAA batteries, AA batteries, etc.). Other types of batteries may be used including rechargeable batteries, aluminum air batteries, lithium batteries, paper batteries, lithium-ion polymer batteries, lithium iron phosphate batteries, magnesium iron batteries etc. Additionally, other types of battery applications may be used and are within the spirit and scope of the present invention. For example, a battery stripper pack may also be used. Additionally, other types of power sources may also be used and are within the spirit and scope of the present invention.

In one embodiment, the shaving razor system 10 may include a covering mechanism configured to securely shield the main blades 24, the first extension blade 29, and the second extension blade 32 from exposure to bacteria and other germs when the shaving razor system 10 is not in use.

Figure 2:
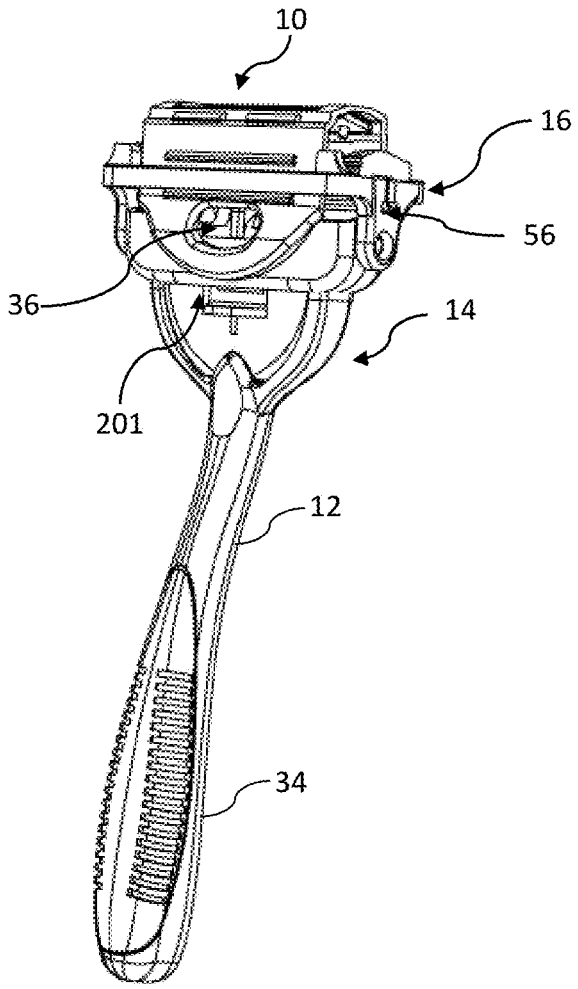
FIG. 2 is a front perspective view of a razor, according to an example embodiment.
Figure 3:
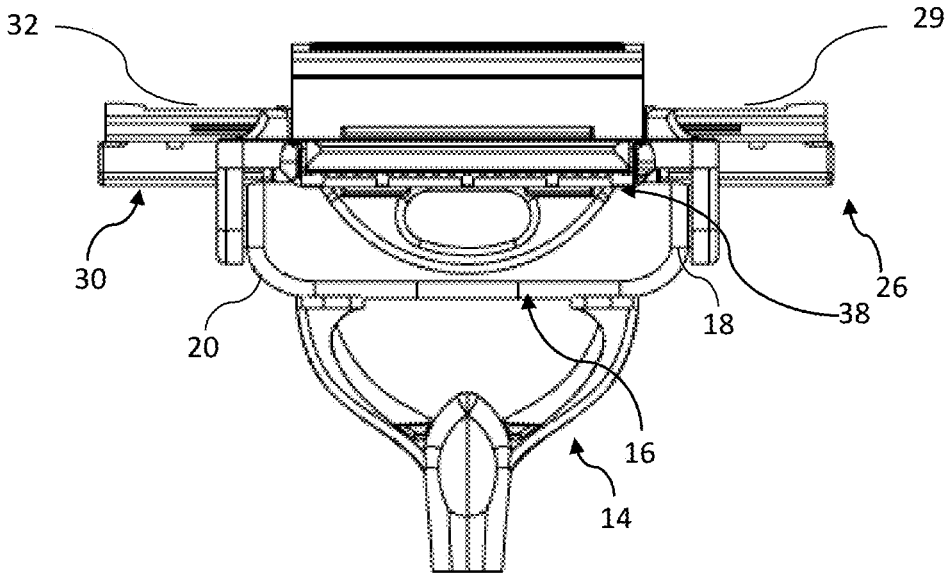
FIG. 3 is a back view of a head of the razor, according to an example embodiment.
Figure 4:
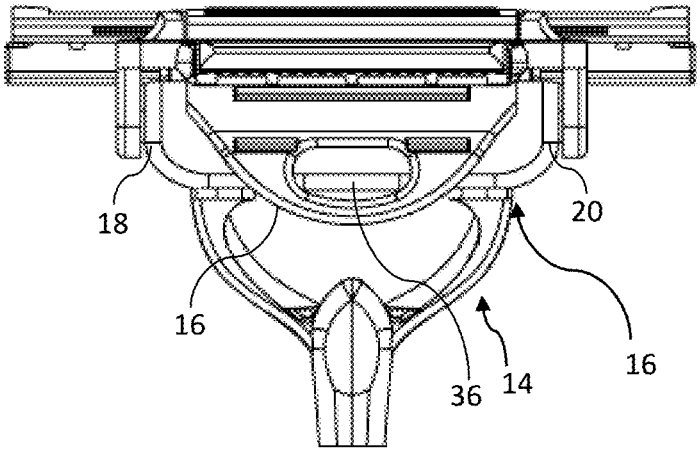
FIG. 4 is a front view of the head of the razor, according to an example embodiment.

Referring now to FIG. 2, a front perspective view is shown of the shaving razor system 10. In one embodiment, at least substantially all of the first extension blade 29 and the second extension blade 32 are positioned between the first end 18 and the second end 20 of the main blade housing assembly 16. In one embodiment, as illustrated in FIG. 2 for example, the shaving razor system 10 may have a stored configuration wherein the first extension blade 29 and the second extension blade 32 are positioned and retained between the first end 18 and the second end 20 of the main blade housing assembly 16 in a non-exposed manner, and an extended configuration (as illustrated in FIG. 3) wherein the first extension blade 29 and the second extension blade 32 protrude beyond the first end 18 and the second end 20 of the main blade housing assembly 16. The shaving razor system 10 may further include an extended flush configuration (as illustrated in FIG. 4 for example) wherein the main blade housing assembly 16, the first extension blade 29, and the second extension blade 32 are substantially flush allowing the first extension blade 29 and the second extension blade 32 to be moderately revealed so that a user may shave more surface area with a single stroke of the razor system. In an embodiment, the main blade housing assembly 16 is defined by an elongated u-shape having the first extension blade housing assembly 26 and the second extension blade housing assembly 30 stored or disposed within the u-shape when in the stored configuration. The elongated u-shape may include a plurality of opposing legs attached to a curved surface configured to support transition of the main blade housing assembly 16 between various configurations. The legs may also include ridges 2105 and 2110 on the outward facing surface of the legs that are configured to maintain the various configurations (extended flush and stored configurations).

The shaving razor system 10 may further include a lock mechanism 41 configured to maintain the first extension blade housing assembly 26 and second extension blade housing assembly 30 in the stored configuration until an unlocking force moves a catch of the lock away from a first extension blade housing assembly stop of the first extension blade housing assembly and a second extension blade housing assembly stop of the second extension blade housing assembly. In one embodiment, the lock or lock mechanism 41 includes a catch component 42 configured to maintain position by applying locking force on a first extension blade stop 44 of the first extension blade housing assembly 26 and a second extension blade stop 46 of the second extension blade housing assembly 30. In the present embodiment, the catch has a u shaped body having two catching surfaces that are configured to abut against the stops 44, 46.

Figure 8:
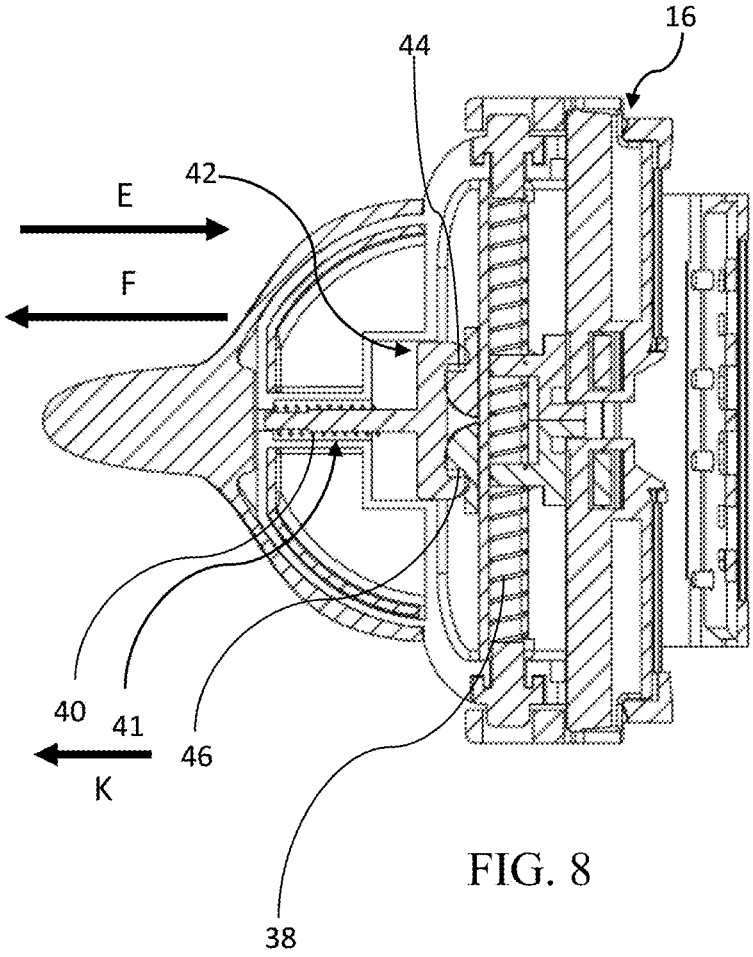
FIG. 8 is a cross-sectional view of a portion of the head of the razor from FIG. 7, wherein the razor is in the stored configuration, according to an example embodiment.

In one embodiment, the system 10 may include a lock biasing element 40 configured to apply a locking force in a first direction (as illustrated in FIG. 8 by line E). The lock biasing element 40 may include one or more springs and is configured to utilize the locking force in the first direction in order maintain the lock mechanism 41 in an engaged position to securely retain the first and second blade extensions in the stored configured. An unlocking force in a second direction (as illustrated in FIG. 8 line F) may be utilized in order to disengage the lock 41 and thus move the catch 42 allowing the first and second extension blades to be released from retention by the lock mechanism 40 such that the catch is moved away from the first and second extension blade stops.

In one embodiment, the shaving razor system 10 may include a remove panel or pad configured for one or more fingers and the main blade housing assembly 16 may be configured to be removed from the handle 12 and/or the head 14 via a push, pop, snap, twist, or any other applicable movements by the one or more fingers on the remove panel or pad in order to detach the main blade housing assembly 16 from the handle 12 and/or the head 14. In one embodiment, the one or more ridged panels 34 may function as the remove panel or pad in order to support detachment of the main blade housing assembly 16 from the handle 12. The main blade housing assembly 16, the first extension blade housing 26, and second extension blade housing assembly 30 may be sold as a complete, replaceable unit.

Referring now to FIG. 3, a back view of the head 14 of the shaving razor system 10 is shown. As illustrated, at least one main blade 24, at least one first extension blade 29, and the second extension blade 32 may be retained in a curved or upright position which may be subject to the positioning of the head 14 and/or the main blade housing assembly 16. In one embodiment, the main blade housing assembly 16, the main blade 24, the first extension blade 29, and the second extension blade 32 may be configured to include a plurality of pivots allowing the main blade 24, the first extension blade 29, and the second extension blade 32 to rotate in a plurality of angles in respect to the application of the shaving razor system 10 to a surface. For example, if a user is applying the shaving razor system 10 to a surface in an upward stroking movement, such as traversing up the neck of a user, the main blade housing assembly 16, the main blade 24, the first extension blade 29, and the second extension blade 32 are configured to utilize the plurality of pivots in order to slightly rotate in respect to the application angle of the shaving razor system 10 applied to the surface allowing for a more efficient shave. In one embodiment, the shaving razor system may include a plurality of main blade 24, the first extension blade 29, and the second extension blade 32 configured to operate in unison with each other, or function independently of one another.

Figure 9:
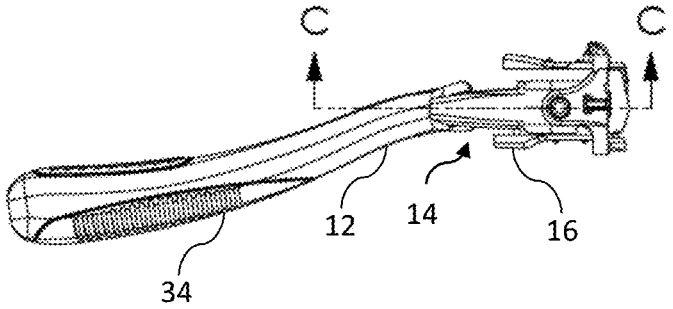
FIG. 9 is a side view of the razor in the extended flush configuration, according to an example embodiment.
Figure 11:
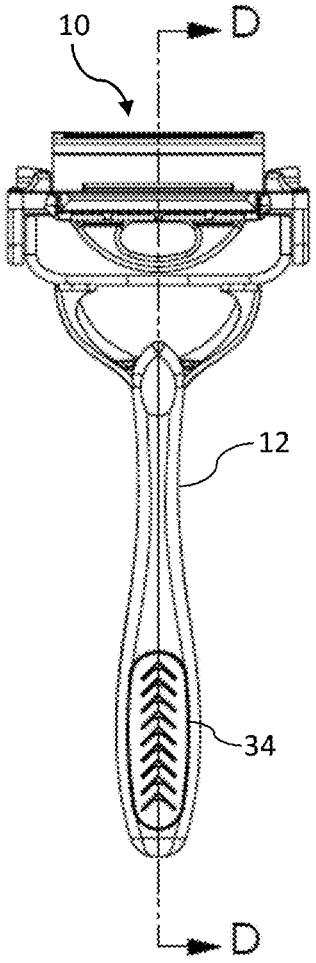
FIG. 11 is a back view of the razor in the stored configuration, according to an example embodiment.
Figure 20:
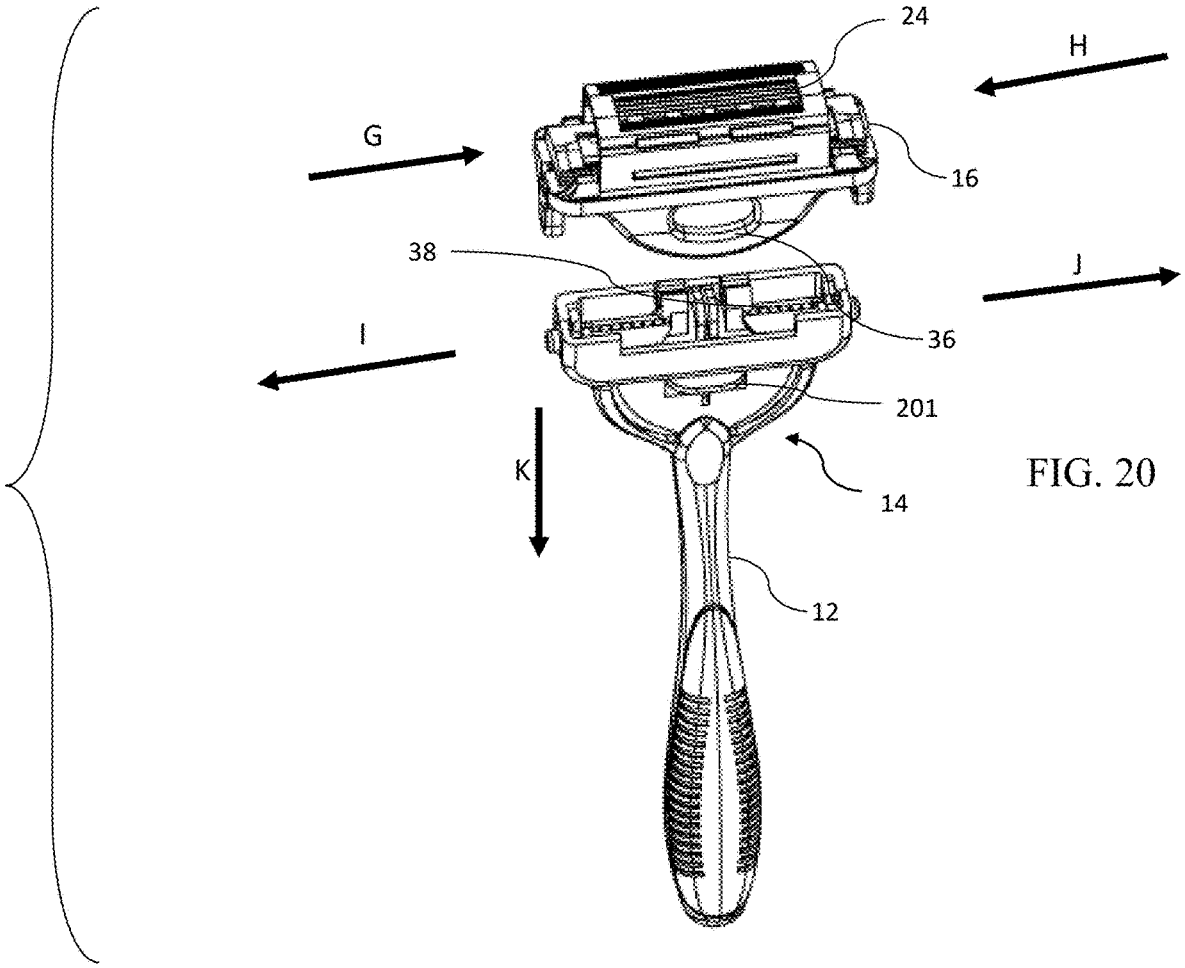
FIG. 20 is an exploded front view of the razor in the stored configuration, according to an example embodiment.

In one embodiment, system 10 includes at least one extension blade biasing element 38 configured to maintain the first and second extension blade housing assemblies in extended configuration. The extension biasing element is configured to continuously bias outward (in the direction of arrowed lines I and J as illustrated in FIG. 20) until an opposing force (in the direction of arrowed lines G and H as illustrated in FIG. 20) greater than the outwardly biasing force provided by the extension blade biasing element act on the extending blade biasing element. In one embodiment, the extension blade biasing element 38 and any other applicable component of system 10 may include one or more coil springs, suspension springs, compression springs, extension springs, torsion springs, constant force springs, or any other applicable mechanism configured to apply the outward force to force the first assembly allowing the shaving razor system 10 to transition from the stored configuration to the extended flush configuration or the extended configuration. In one embodiment, in operation a user 100 applies a force (as illustrated in FIGS. 9 and 11; lines C and D) to lever 201 which then applies an unlocking force to the extension blade biasing element 38 greater than the force applied by the springs of the lock biasing element 40 in order to move the catch away from the stops. After the catch moves away from the stops, the outward force of the extension blade biasing element 38 moves the first extension blade and housing and second extension blade and housing outward into either the extended configuration or extended flush configuration until an inward force greater than the force provided by the outward force of the extension blade biasing element acts on it.

Referring now to FIG. 4, a front view of the head 14 of the shaving razor system 10 in an upright vertical position is shown. The head 14 and the main blade housing assembly 16 are configured to cooperate in order to allow for upward tilting or a tip angle of the main blade housing assembly 16 when the shaving razor system 10 is rested upon a surface; thus, preventing the main housing assembly 16 and the main blade 24 from contact with the surface while simultaneously allowing the handle 12 and the head 14 to have contact with the surface that the shaving razor system 10 is resting on.

Figure 5:
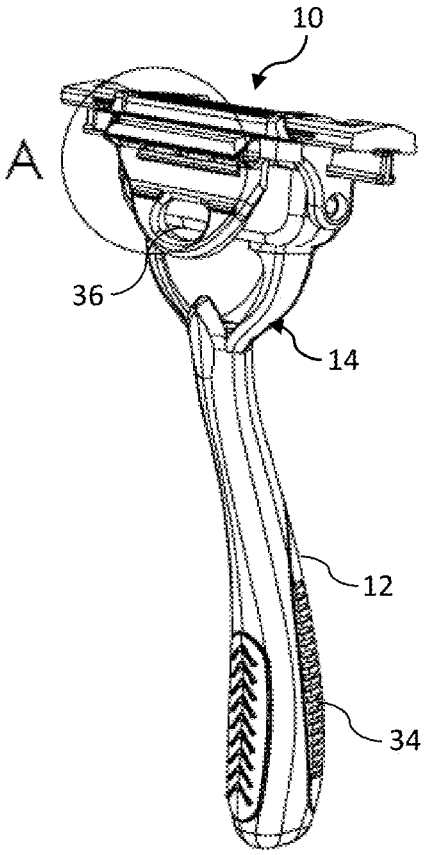
FIG. 5 is a second back perspective view of the razor, according to an example embodiment.

Referring now to FIG. 5, a second back view of the shaving razor system 10 is shown. In one embodiment, the one or more ridged panels 34 may simultaneously function as the remove panel or pad in addition to a covering or enclosing component for the internal cavity of the handle 12 in order to protect or enclose wiring or any other applicable power sources that may be housed within the handle 12 to provide power to the shaving razor system 10. In certain embodiments, the head 14 may include a finger pad or finger cavity 36 configured to support removal of the main blade housing assembly 16 from the head 14.

Figure 6:
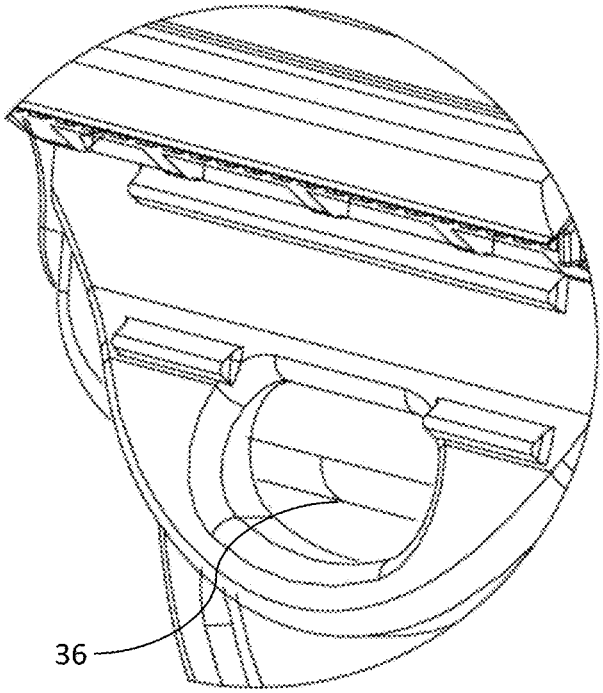
FIG. 6 is a zoomed in view of a portion of the second back perspective view of the razor from FIG. 5, according to an example embodiment.

Referring now to FIG. 6, a zoomed in view of a portion of the second back perspective of the shaving razor system 10 is shown. In one embodiment, the head 14 is separated from the main blade housing assembly 16 by the user 100 using one hand to firmly grasp the shaving razor system 10 by the one or more ridged panels 34 and the other hand to grasp the base of the main blade housing assembly 16, aligning a digit within the finger cavity 36, and pulling the main blade assembly 16 and the handle 12 in polar opposite directions.

Figure 7:
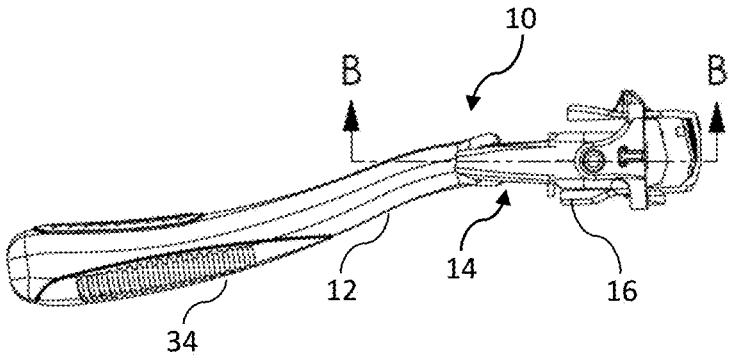
FIG. 7 is a side view of the razor in the stored configuration, according to an example embodiment.

Referring now to FIG. 7, a side view of the shaving razor system 10 in the stored configuration. The shaving razor system 10 is illustrated as being substantially aligned with the longitudinal axis (represented by dotted line B). In one embodiment, the lock mechanism includes a surface configured to abut the first extension blade stop 44 and the second extension blade stop 46 (as illustrated in FIG. 8). In one embodiment, the shaving razor system may include a plurality of lock or lock mechanism 41 each configured to maintain the first and second extension blade and assemblies in the stored configuration. The lock mechanism 40 is configured to maintain first and second extension blade and assemblies in the stored configuration until one or more actions are performed by the user 100 to transition into the extended configuration wherein the first extension blade 29 and the second extension blade 32 protrude beyond the first end 18 and the second end 20 of the main blade housing assembly 16.

Referring now to FIG. 8, a cross-sectional view of the head 14 taken along hashed or dotted line B. while the shaving razor system 10 is in the stored configuration is illustrated. As shown, the main blade housing assembly 16 retains the main blade 24, the first extension blade housing assembly 26 has mounted on it the first extension blade 29, and the second extension blade housing assembly 30 has mounted on it the second extension blade 32. When in stored configuration, the lock mechanism 41 is in an engaged or retaining mode applying a locking force (as illustrated in FIG. 8 line E) allowing unexposed retention of the first extension blade 29 and the second extension blade 32 between the first end 18 and the second end 20. When extended or non-extended flush configuration is desired, user 100 applies an unlocking force in the second direction (as illustrated in FIG. 8 line F) which includes enough force to move the catch component 42 away from the first extension blade stop 44 and/or the second extension blade stop 46.

In one embodiment, the extension blade biasing element 38 is configured to maintain the first extension blade 29 in the first extension blade housing assembly 26 and the second extension blade 32 and the second extension blade housing 30 in the extended configuration. The catch component 42 of the lock mechanism 41 provides the locking force in the direction of line E on the first extension blade stop 44 and the second extension blade stop 46 until the user 100 applies the unlocking force in the direction of line F to the extension blade biasing element 38, which acts on the lock mechanism 41 by providing enough force to move the catch component 42 away from the first extension blade stop 44 and the second extension blade stop 46. In one embodiment, the shaving razor system 10 may include more than one blade biasing element and/or locking mechanism allowing independent operation (extended configuration) of the first extension blade 29, the second extension blade 32, and/or the main blade 24. In other words, the main blade 24 may perform normal operations while the extension blade 29 and the second extension blade 32 are being held in the stored configuration by the lock mechanism 41, the first extension blade 29 may remain in extended configuration while the second extension blade 32 remains in stored configuration, or the second extension blade 32 may remain in extended configuration while the first extension blade 29 remains in stored configuration. In one embodiment, the one or more extension blade biasing elements 38 are each allocated to separate blade housings allowing maintenance of each respective extension blade assembly. Additionally, in certain embodiments, only one extension blade may be provided sot that only one extension blade extends from the main blade housing assembly when in the extended configuration and extended flush configuration.

In stored configuration, retention of at least the first extension blade 29 and the second extension blade 32 is maintained by the catch component 42 of the lock mechanism 41 continuously applying the locking force E on the first extension blade stop 44 and/or the second extension blade stop 46. In one embodiment, the first extension blade housing assembly 26 includes a first extension rail 50 and the second extension blade housing assembly 30 includes a second extension rail 52 (as illustrated in FIG. 20). The first extension rail 50 and the second extension rail 52 are configured to support extension of the first extension blade 29 and the second extension blade 32 beyond the first end 18 and the second end 20 of the main blade housing assembly 16 during the transition from stored configuration into non-extended flush configuration or extended configuration.

Referring now to FIG. 9, a side view of the shaving razor system 10 in the extended flush configuration is illustrated. The shaving razor system 10 is illustrated as being substantially aligned with the longitudinal axis. The extension blade biasing element 38 is biased by pushing against the main blade 24, the first extension blade 29, and/or the second extension blade 32 supporting the guiding of the blades by the first extension rail 50 and the second extension rail 52.

When the shaving razor system 10 is in the stored configuration, the lock biasing element 40 is configured to receive unlocking forces from user 100 resulting in the lock mechanism 41 being disengaged and the first and second extension blades protruding continuously or incrementally.

In one embodiment, the unlocking force (as illustrated in FIG. 20 in the direction of arrowed line K) push the extension blade biasing element 38 into a locked position wherein the first and second extension blades are securely retained and locked in an extended configuration or in some configurations slightly protruded. In one embodiment, user 100 may apply locking forces which push the extension blade biasing element 38 into an unlocked position wherein the first and second extension blades are retracted and transition into stored configuration while both the lock biasing element 40 and lock mechanism 41 are subsequently engaged. Applying force on the extension blade biasing element 38 in a first direction causes a first force to act on the lever of the extension blade biasing element 38 causing the extension blade biasing element 38 to maintain the first and second extension housing assemblies. Applying force to the extension blade biasing element 38 in a second direction causes a second force to act on the lock mechanism 41 causing not only the first and second extension blades to retract inside the first and second extension housing assemblies respectively, but also allowing the catch component 42 to subsequently apply force on the first and second blade extension stops once the first and second extension blades have retracted. In one embodiment, the functioning of the extension blade biasing element 38 may be accomplished by a springing motion, sliding motion, or clicking motion by user 100 associated with a switch, button, pad, clicking wheel, adjustable knob, or any other applicable mechanism affixed to the shaving razor system configured to support continuous or incremental protrusion of the first and second extension blades. Upon application of the unlocking force to the extension blade biasing element 38, the first extension blade 29 and the second extension blade 32 protrude or extend in a substantially flushed manner along the first extension rail 50 and the second extension rail 52 respectively. In one embodiment, the first extension blade 29 and the second extension blade 32 may be extended individually or in combination by the aforementioned switch, button, or any other applicable mechanism affixed to the shaving razor system 10 interconnected with the one or more extension blade biasing element 38.

Figure 10:
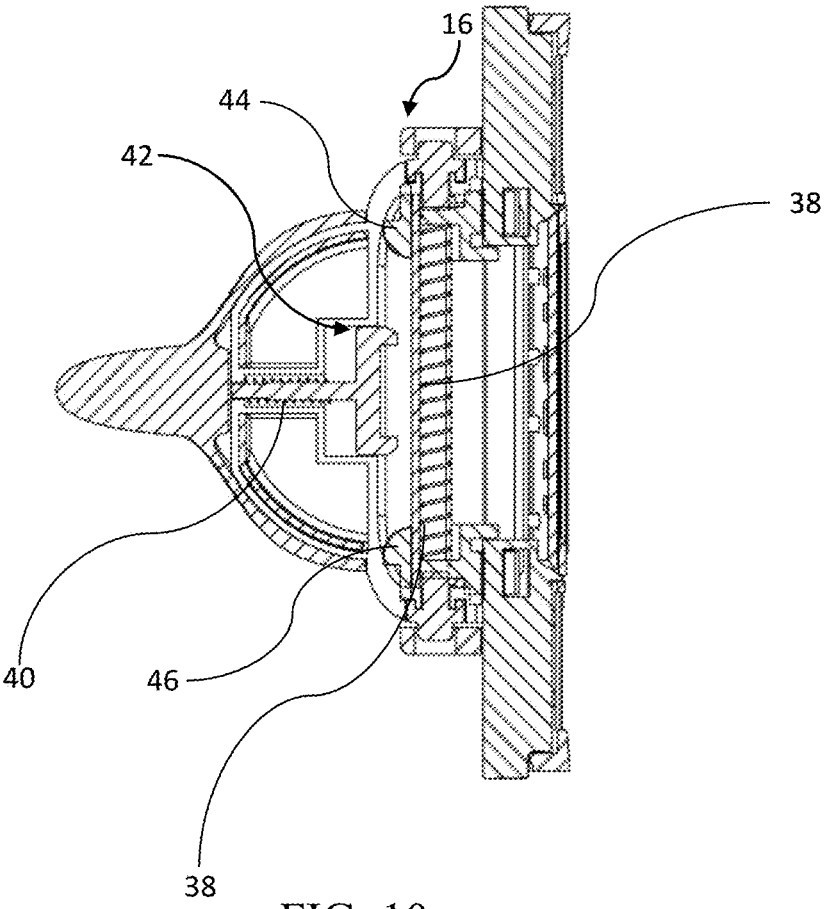
FIG. 10 is a cross-sectional view of a portion of the head of the razor from FIG. 9, wherein the razor is in extended flush configuration, according to an example embodiment.
Figure 12:
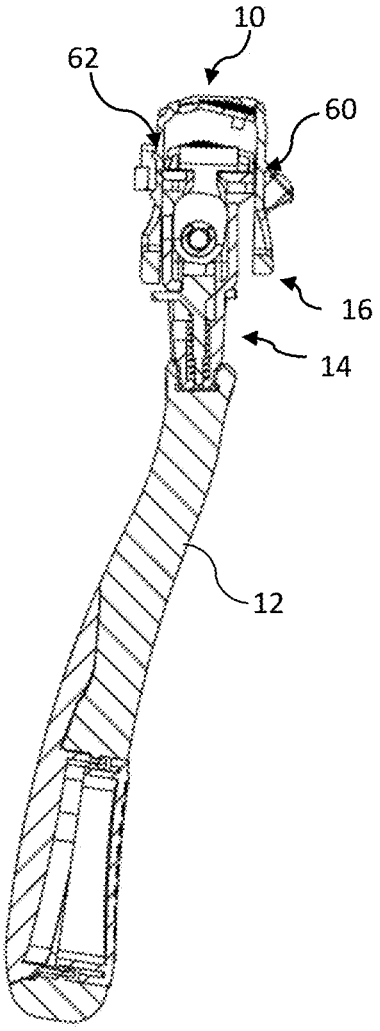
FIG. 12 is a side cross-sectional view of the razor in the stored configuration, according to an example embodiment.

Referring now to FIG. 10, a cross-sectional view of the head 14 while the shaving razor system 10 is in the extended flush configuration is illustrated. In one embodiment, the shaving razor system 10 includes a non-extended flush configuration wherein the first and second extension blades are substantially flushed, herein described as being even or at least substantially even, in respect to each other, the main blade 24, and any other applicable component of the shaving razor system 10. The substantially flush configuration allows the shaving razor system 10 to come into contact with a skin surface of user 100 to cut hairs in perpendicular relation to relatively stiff areas of hair that are adjacent to the skin surface; thus, eliminating stubble associated with the user 100. Furthermore, this configuration allows user 100 to shave a larger surface area in a significantly less amount of time compared to shaving razors in the industry due to the first and second extension blades and their ability to efficiently cover larger areas of hair via extended consistent strokes of the shaving razor system 10 along the surface. In one embodiment, the covering mechanism may include a plurality of enclosable openings configured to allow the main blade 24, the first extension blade 29, and the second extension blade 32 to penetrate through the plurality of enclosable openings when protruding or extending in a substantially flushed manner. In one embodiment, the covering mechanism may be affixed to shaving razor system 10 and function as a component of the head 14, such as a head housing assembly including a first elongated slot 60 and a second elongated slot 62 configured for receiving the plurality of legs of the main blade housing assembly 16 (illustrated in FIGS. 12 and 14). In one embodiment, the head housing assembly includes a first opening 56 and a second opening 58 (best illustrated in FIGS. 2 and 21) configured for the first extension rail 50 and the second extension rail 52 to translate through resulting in extended configuration of the first extension blade 29 and the second extension blade 32. In application, the user applies the unlocking force, via one of the previously disclosed methods, allowing the first extension blade 29 and the second extension blade 32 to transition into the extended configuration via an incremental or continuous movement via translation of the first extension rail 50 and the second extension rail 52 through the first opening 56 and second opening 58.

The head 14 includes a first elongated slot 60 and a second elongated slot 62 which are configured to receive the plurality of legs of the main blade housing assembly 16 in order to allow the main blade housing assembly 16 to transition between various configurations, especially between the non-extended flush configuration and the extended flush configuration. In the non-extended flush or stored configuration, the catch component 42 of the lock mechanism 41 may be disengaged or removed from the first extension blade stop 44 and the second extension blade stop 46, to allow the first extension blade housing assembly 26 and the second extension blade housing assembly 30 that are not fully protruded or extended beyond the first end 18 and the second end 20 of the main blade housing assembly 16 due to the positioning of the plurality of legs relative to the first elongated slot 60 and the second elongated slot 62 to move into the extended flush configuration.

Referring now to FIGS. 9 and 10, the shaving razor system 10 in the extended flush configuration is illustrated. FIG. 10 illustrates a cross-sectional view of the shaving razor system 10 taken along represented by dotted line C from FIG. 9, in which the shaving razor system 10 is in an upright position and the catch component 42 of the lock mechanism 41 is disengaged or removed from the first extension blade stop 44 and the second extension blade stop 46 allowing the first extension blade 29 and the second extension blade 32 to fully protrude or extend beyond the first end 18 and the second end 20 of the main blade housing assembly 16 via the first extension rail 50 and the second extension rail 52. In this configuration the extension biasing element 38 maintains the first extension blade 29 and the second extension blade 32 and their respective housings in the extended configuration.

Figure 13:
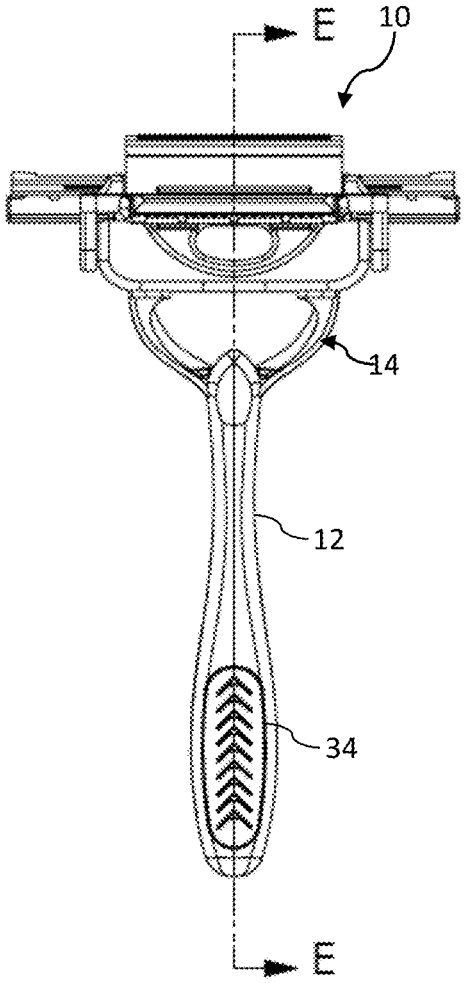
FIG. 13 is a back view of the razor in the extended configuration, according to an example embodiment.
Figure 14:
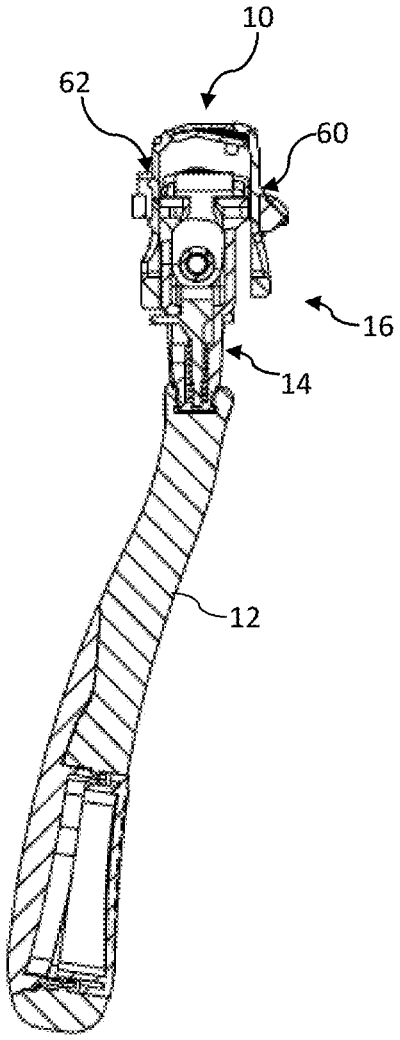
FIG. 14 is a side cross-sectional view of the razor in the extended configuration, according to an example embodiment.
Figure 15:
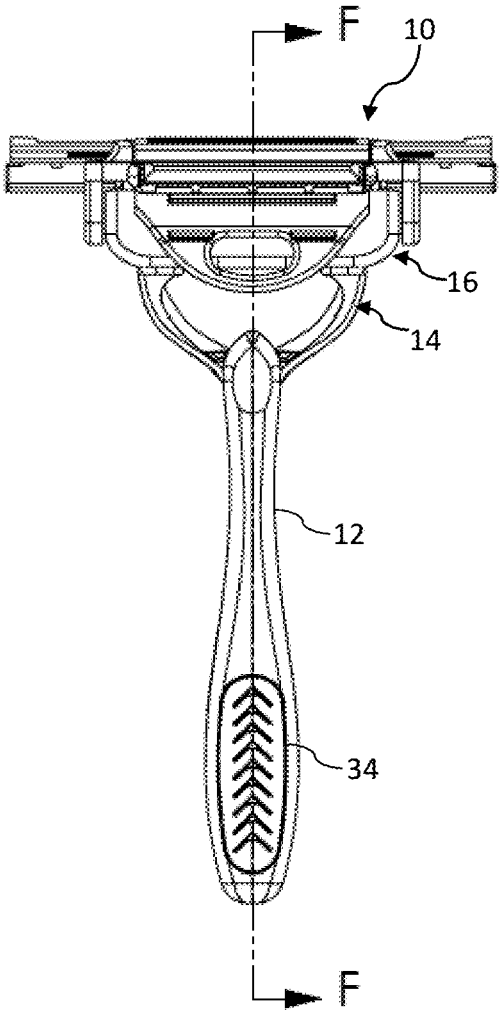
FIG. 15 is a back view of the razor in the extended flush configuration, according to an example embodiment.
Figure 16:
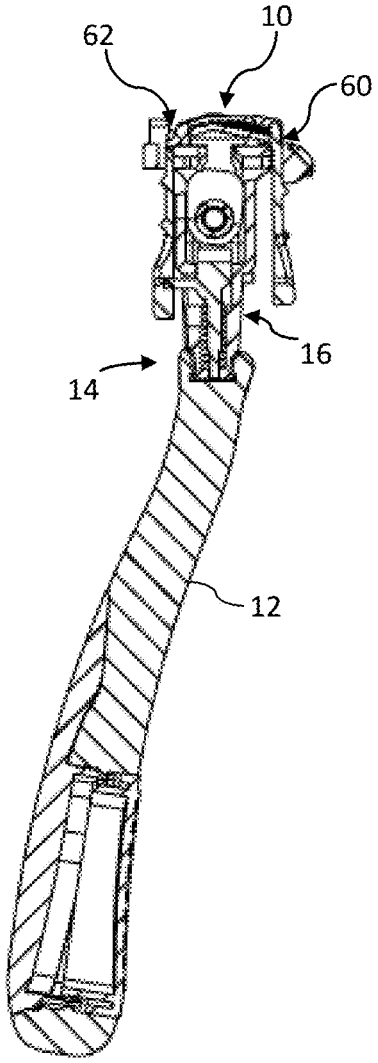
FIG. 16 is a side cross-sectional view of the razor in the extended flush configuration, according to an example embodiment.

Referring now to FIGS. 13 and 14, the shaving razor system 10 depicts the shaving razor system 10 as wherein the shaving razor system 10 is depicted in an upright position in the extended configuration, in FIGS. 15 and 16 the shaving razor system 10 is illustrated in an upright position in the extended flush configuration. The catch component 42 of the lock mechanism 41 is disengaged or removed from the first extension blade stop 44 and the second extension blade stop 46 allowing the first extension blade 29 and the second extension blade 32 to protrude or extend beyond the first end 18 and the second end 20 of the main blade housing assembly 16 based on the positioning of the plurality of legs relative to the first elongated slot 60 and the second elongated slot 62 of the head housing assembly. In one embodiment, the level of protrusion of the first extension blade 29 and the second extension blade 32 may vary based upon the preference of the user 100. The user may move the device between the extended flush configuration and extended configuration by applying force (in one embodiment by applying force using a digit of the user 100) on the finger cavity 36 or any other applicable adjustable knob, switch, or button configured to toggle the length of protrusion of the first extension blade 29 and the second extension blade 32 relative to the first end 18 and the second end 20 of the main blade housing assembly 16. Said mechanisms of adjustment may also be applicable to the transition of the main blade housing assembly 16 between extended configuration and extended flush configuration based on the location of the plurality of legs within the first elongated slot 60 and the second elongated slot 62.

Figure 17:
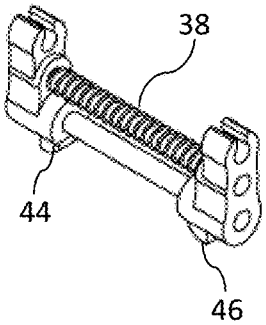
FIG. 17 is a perspective view of a blade extension biasing element in the extended configuration, according to an example embodiment.
Figure 18:
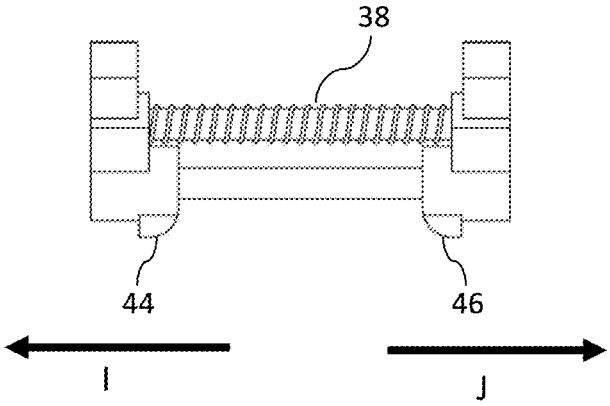
FIG. 18 is a front view of the blade extension biasing element in the extended configuration, according to an example embodiment.
Figure 19:
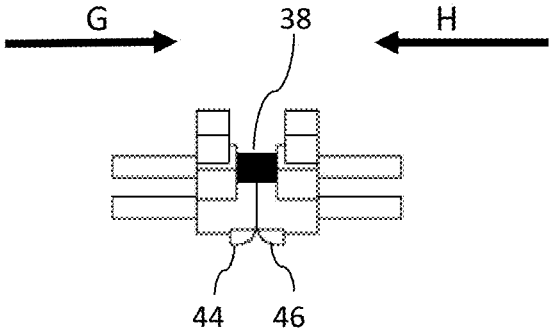
FIG. 19 is a front view of the blade extension biasing element in the stored configuration, according to an example embodiment.

Referring now to FIGS. 17-19, the extension blade biasing element 38 is illustrated. In one embodiment, the extension blade biasing element 38 is configured to maintain the first extension blade housing assembly 26 and the second extension blade housing assembly 30 in the extended configuration. The extension blade biasing element 38 may be plastic, titanium, or any other applicable alloy, metal, or combination thereof. The extension blade biasing element 38 is configured to work in opposition of the lock mechanism 41. When shaving razor system 10 is in stored configuration, the catch component 42 of lock mechanism is engaged on the first extension blade stop 44 and the second extension blade stop 46 while the extension blade biasing element 38 may be biased against the first and second extension blades. When shaving razor system 10 is in extended configuration or extended flush configuration, the catch component 42 is released by an unlocking force to a lever 201 which then compresses the biasing element 40 any moves the catch away from the stops and the extension blade biasing element 38 decompress and provides an outward thrust forcing protrusion of the first extension blade 29 via the first extension blade housing assembly 26 and the second extension blade 32 via the second extension blade housing assembly 30 outward through the first opening 56 and second opening 58 of the main housing assembly. In one embodiment, protrusion of the first extension blade 29 and the second extension blade 32 may be accomplished by allowing the first extension rail 50 disposed on the back of first extension blade housing assembly 26 and the second extension rail 52 on the back of the second extension blade housing assembly 30 translating through the first opening 56 and a second opening 58 of the head housing assembly.

Figure 21:
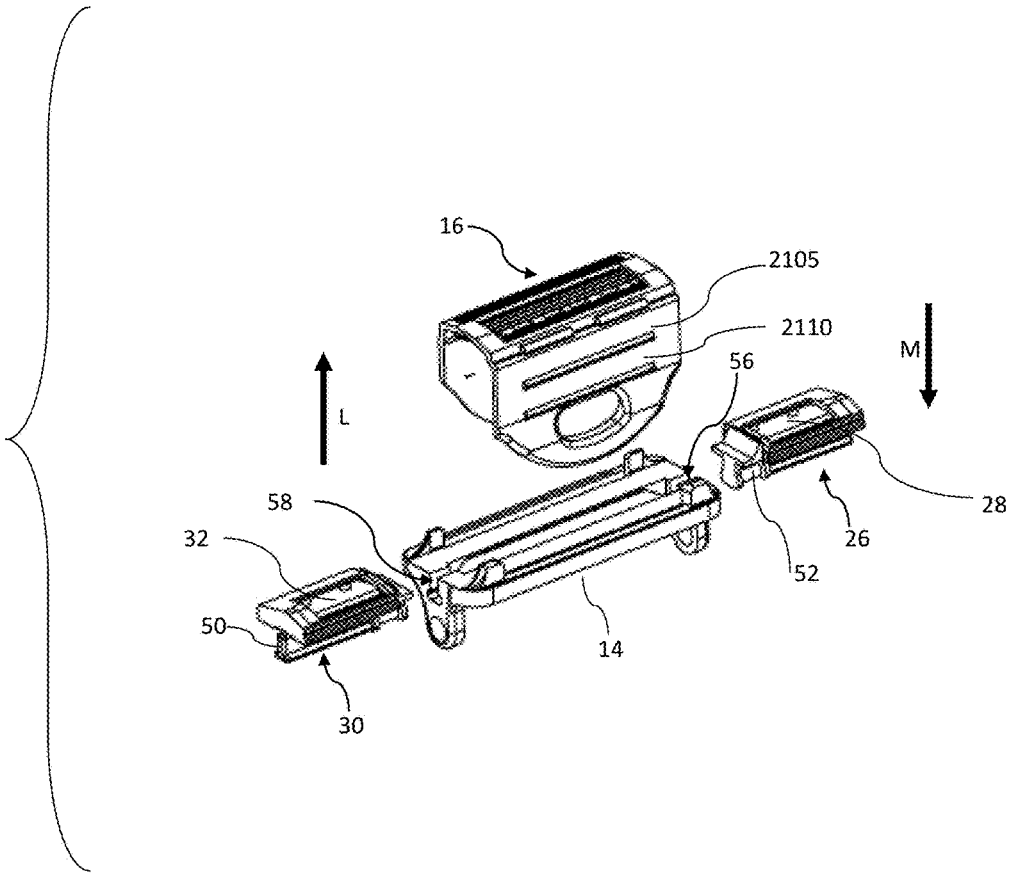
FIG. 21 is a front view of components of a head of the razor, according to an example embodiment; and, FIG. 22 is a perspective view of the razor in the extended flush configuration being used by a user, according to an example embodiment.

Referring now to FIGS. 20-21, the shaving razor system 10 includes a first ridge 2105 and a second ridge 2110 configured to assist the first elongated slot 60 and the second elongated slot 62 of the head housing assembly (as illustrated in FIGS. 14 and 16) with maintaining the main housing assembly 16 in the storage configuration (as illustrated in FIGS. 1 and 2), extended configuration (as illustrated in FIG. 3) and extended flush configuration (as illustrated in FIG. 4) based on the positioning of the plurality of legs.

When in stored configuration, the biasing element 40 of the lock mechanism 41 provides locking forces in the direction of line (as illustrated in FIG. 8) securely retaining and maintaining the first and second extension blades in their respective housing assemblies in an unexposed manner. User 100 must apply a confronting or unlocking force (as illustrated in FIG. 20 in the direction of arrowed line K) to the lever to move the lock biasing element 40 of the lock 41 away from the stops 44, 46 (in the direction of arrowed line F as illustrated in FIG. 8) in order to allow the extension blade biasing element 38 to provide an outward force (in the direction of arrowed line I and J) to move the blade extensions outward in the same direction. System 10 may further include a lever 201 configured to utilize a downward force (as illustrated in FIG. 20 line K) applied by user 100 in order to release the main housing assembly 16 from the head 14. In one embodiment, the lever 201 is affixed to the head housing assembly and the downward force K applied to lever 201 may function as a mechanism to move the catch component 42 away from the first and second extension blade stops. In one embodiment, system 10 is configured to be disassembled and components thereof are configured to be replaceable. In one embodiment, the first elongated slot 60 and the second elongated slot 62 of the head housing assembly are configured to support disposal of the first and second extension blade housing assemblies when the shaving razor system 10 is in stored configuration. The first elongated slot 60 and the second elongated slot 62 are further configured to receive the legs of the main blade housing assembly 16 in a manner that allows the main blade housing assembly 16 to move bidirectionally (represented by FIG. 21 in lines L and M), allowing the shaving razor system 10 to move between the non-extended flush configuration and the extended flush configuration. In one embodiment, the first extension and second extension rails 50, 52 are configured to translate through the first opening 56 and the second opening 58 of the head housing assembly in the directions of both line I and J. In application, once the locking mechanism 41 is disengaged and the extension blade biasing element 38 is moved away from the stops, the first and second extension blade housing assemblies and the first and second extensions blades are permitted to protrude in either extended configuration or extended flush configuration, individually or in combination by translating through the first and second openings. In one embodiment, the main blade housing assembly 16 including the first extension blade housing assembly 26 and the second extension blade housing assembly 30 is configured to function as a complete unit, and may be disposable. The main blade housing assembly 16 is configured for mounting to the head 14 through injection molding or other typical manufacturing techniques.

Figure 22:
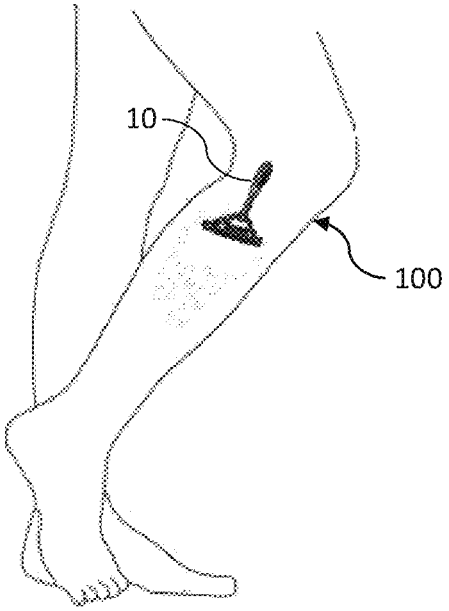

Referring to FIG. 22, the shaving razor system 10 is configured to be utilized by the user 100. The shaving razor system 10 as illustrated and described above allows the user 100 to significantly reduce the effort of user 100 needed to effectively shave target areas of varying sizes containing a plurality of hair due to the first extension blade 29 and the second extension blade 32 having the ability to work in cooperation with the main blade 24 in order to provide a more effective shave. This more effective shave accomplished by the shaving razor system 10 results in not only a more efficient manner to target massive areas comprising a significant amount of hair, but also a more efficient manner for shaving those target massive areas that conserves a significant amount of time for the user 100.

In operation, in order to move from the extended configuration to the stored configuration, force is applied to the lever, which keeps the catch clear of the space afforded for the stops within the main housing assembly. Additionally, force (in the direction of arrowed line G and H) is applied to the first and second housing extensions in order to compress the outwardly biasing element 38 so that the stops 44, 46 move back to the position as illustrated in FIGS. 19 and 20. After the stops are in the position as illustrated in FIG. 20, a user may remove the force from the lever (that is being allied in the direction of arrowed line K) to allow the lock biasing element 40 to move the lock's catch to move (in the direction of arrowed line E as illustrated in FIG. 8) to the position illustrated in FIG. 8 so that the lock may maintain the first and second blades and housing assembles in the stored configuration.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A razor for shaving comprising:

a handle;

a head connected to a upper end of the handle;

at least one main blade mounted on a main blade housing assembly that is movably attached relative to the head, wherein the main blade housing assembly has a first end and a second end;

at least one first extension blade mounted on a first extension blade housing assembly, wherein the first extension blade housing is movably engaged with the head;

at least one second extension blade mounted on a second extension blade housing assembly wherein the second extension blade housing is movably engaged with the head;

wherein in a stored configuration at least substantially all of the at least one first extension blade, first extension blade housing assembly, the at least one second extension blade are both positioned between the main blade housing assembly's first end and second end; and, wherein in an extended configuration at least substantially all of the at least one first extension blade, first extension blade housing assembly, the at least one second extension blade and the second extension blade housing assembly extends beyond the main blade housing assembly's first end and second end.

2. The razor of claim 1, wherein an extension blade biasing element maintains the first extension blade housing assembly in the extended configuration and the second extension blade housing assembly in the extended configuration; and, wherein the extension blade biasing element is in connection with the head.

3. The razor of claim 1, wherein a lock in connection with the head maintains the first extension blade housing assembly and second extension blade housing assembly in the stored configuration until an unlocking force provided by a user moves a catch of the lock away from a first extension blade housing assembly stop of the first extension blade housing assembly and a second extension blade housing assembly stop of the second extension blade housing assembly.

4. The razor of claim 3, wherein a lock biasing element providing a locking force maintains the lock in an engaged position unless the unlocking force provided by the user acts on the lock biasing element to overcome the locking force to move the catch of the lock away from the stops.

5. The razor of claim 1, further comprising a head housing assembly, wherein the main blade housing is movably in attachment with the head housing assembly;

wherein the first extension blade housing assembly includes a first rail movably engaged with the head housing assembly;

wherein the second extension blade housing assembly includes a second rail movably engaged with the head housing assembly;

and wherein in an extended flush configuration the razor is in an extended configuration and at least one blade of the first extension blade housing assembly, main housing assembly and second extension blade housing assembly are substantially flush.

6. The razor of claim 5, wherein the main blade housing assembly defines an elongated u shape, and wherein the first extension blade housing assembly and second extension blade housing assembly are disposed inside the elongated u shape when in the stored configuration.

7. The razor of claim 5, wherein in a first elongated slot and a second elongated slot on the head housing assembly receives a pair legs of a u shape of the main blade housing assembly to allow the main blade housing assembly to move between a non-extended flush configuration and the extended flush configuration; wherein in the extended non-flush configuration the razor is in the extended configuration and the at least one blade of the first extension blade housing assembly, main housing assembly and second extension blade housing assembly are not substantially flush.

8. The razor of claim 5, wherein the first rail is disposed on a back side of first extension blade housing assembly and wherein the second rail is disposed on a back side of second extension blade housing assembly.

9. The razor of claim 8, wherein the first rail is configured to translate through a first opening on a first side of the head housing assembly and the second rail is configured to translate through a second opening on a second side of the head housing assembly.

10. A razor for shaving comprising:

a handle connected to the upper end of the handle;

a head connected to a upper end of the handle;

at least one main blade mounted on a main blade housing assembly that is moveably attached relative to the head, wherein the main blade housing assembly has a first end and a second end;

at least one first extension blade mounted on a first extension blade housing assembly, wherein the first extension blade housing is movably engaged with the head;

at least one second extension blade mounted on a second extension blade housing assembly;

wherein the second extension blade housing is movably engaged with the head;

wherein in a stored configuration at least substantially all of the at least one first extension blade, first extension blade housing assembly, the at least one second extension blade are both positioned between the main blade housing assembly's first end and second end; and, wherein in an extended configuration at least substantially all of the at least one first extension blade, first extension blade housing assembly, the at least one second extension blade and the second extension blade housing assembly extends beyond the main blade housing assembly's first end and second end;

wherein in an extended flush configuration the razor is in an extended configuration and at least one blade of the first extension blade housing assembly, main housing assembly and second extension blade housing assembly are substantially flush; and wherein an extension blade biasing element maintains the first extension blade housing assembly in the extended configuration and the second extension blade housing assembly in the extended configuration; and, wherein the extension blade biasing element is in connection with the head.

11. The razor of claim 10, wherein a lock in connection with the head maintains the first extension blade housing assembly and second extension blade housing assembly in the stored configuration until an unlocking force provided by a user moves a catch of the lock away from a first extension blade housing assembly stop of the first extension blade housing assembly and a second extension blade housing assembly stop of the second extension blade housing assembly.

12. The razor of claim 11, wherein a lock biasing element providing a locking force maintains the lock in an engaged position unless the unlocking force provided by the user acts on the lock biasing element to overcome the locking force to move the catch of the lock away from the stops.

13. The razor of claim 10, further comprising a head housing assembly, wherein the main blade housing is movably in attachment with the head housing assembly;

wherein the first extension blade housing assembly includes a first rail movably engaged with the head housing assembly;

wherein the second extension blade housing assembly includes a second rail movably engaged with the head housing assembly;

wherein in an extended flush configuration the razor is in an extended configuration and at least one blade of the first extension blade housing assembly, main housing assembly and second extension blade housing assembly are substantially flush; and, wherein the main blade housing assembly defines an elongated u shape, and wherein the first extension blade housing assembly and second extension blade housing assembly are disposed inside the elongated u shape when in the stored configuration.

14. The razor of claim 13, wherein in a first elongated slot and a second elongated slot on the head housing assembly receives a pair legs of a u shape of the main blade housing assembly to allow the main blade housing assembly to move between a non-extended flush configuration and the extended flush configuration; wherein in the extended non-flush configuration the razor is in the extended configuration and the at least one blade of the first extension blade housing assembly, main housing assembly and second extension blade housing assembly are not substantially flush.

15. The razor of claim 13, wherein the first rail is disposed on the back side of the first extension blade housing assembly and wherein the second rail is disposed on a back side of the second extension blade housing assembly.

16. The razor of claim 15, wherein the first rail is configured to translate through a first opening on a first side of the head housing assembly and the second rail is configured to translate through a second opening on a second side of the head housing assembly.

17. A razor for shaving comprising:

a handle connected to the upper end of the handle;

a head connected to a upper end of the handle;

a main blade mounted on a main blade housing assembly that is moveably attached to the head, wherein the main blade housing assembly has a first end and a second end;

at least one first extension blade mounted on a first extension blade housing assembly, wherein the first extension blade housing is movably engaged with the head;

at least one second extension blade mounted on a second extension blade housing assembly wherein the second extension blade housing is movably engaged with the head;

wherein in a stored configuration at least substantially all of the at least one first extension blade, first extension blade housing assembly, the at least one second extension blade are both positioned between the main blade housing assembly's first end and second end; and, wherein in an extended configuration at least substantially all of the at least one first extension blade, first extension blade housing assembly, the at least one second extension blade and the second extension blade housing assembly extends beyond the main blade housing assembly's a first end and second end.

18. The razor of claim 17, wherein an extension blade biasing element maintains the first extension blade housing assembly in the extended configuration; and, wherein the extension blade biasing element is in connection with the head.

19. The razor of claim 17, wherein a lock in connection with the head maintains the first extension blade housing assembly in the stored configuration until an unlocking force provided by a user moves a catch of the lock away from a first extension blade housing assembly stop of the first extension blade housing assembly.

20. The razor of claim 19, wherein a lock biasing element providing a locking force maintains the lock in an engaged position unless the unlocking force provided by the user acts on the lock biasing element to overcome the locking force to move the catch of the lock away from the stops.

* * * * *